US010045430B2

(12) United States Patent
Wendt et al.

(10) Patent No.: US 10,045,430 B2
(45) Date of Patent: Aug. 7, 2018

(54) LIGHTING SYSTEM AND METHOD FOR OPERATING A LIGHTING SYSTEM

(75) Inventors: Matthias Wendt, Wuerselen (DE); Wolfgang Otto Budde, Aachen (DE); Aweke Negash Lemma, Eindhoven (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 1519 days.

(21) Appl. No.: 12/864,520

(22) PCT Filed: Jan. 26, 2009

(86) PCT No.: PCT/IB2009/050295

§ 371 (c)(1),
(2), (4) Date: Jul. 26, 2010

(87) PCT Pub. No.: WO2009/095833

PCT Pub. Date: Aug. 6, 2009

(65) Prior Publication Data

US 2010/0309016 A1 Dec. 9, 2010

(30) Foreign Application Priority Data

Jan. 30, 2008 (EP) ..... 08101106

(51) Int. Cl.
*G08B 21/00* (2006.01)
*H05B 37/02* (2006.01)

(52) U.S. Cl.
CPC ..... *H05B 37/029* (2013.01)

(58) Field of Classification Search
CPC ..... H05B 37/029
USPC ..... 340/3.1, 3.52, 825.69, 825.71; 315/151, 315/291, 307; 250/214 R
See application file for complete search history.

(56) References Cited

U.S. PATENT DOCUMENTS

| | | | | |
|---|---|---|---|---|
| 6,009,523 | A | 12/1999 | Owaki et al. | |
| 6,333,605 | B1 | 12/2001 | Grouev et al. | |
| 2002/0145394 | A1* | 10/2002 | Morgan et al. | 315/291 |
| 2005/0275626 | A1 | 12/2005 | Mueller et al. | |
| 2007/0258523 | A1 | 11/2007 | You et al. | |
| 2008/0284348 | A1* | 11/2008 | Cortenraad et al. | 315/291 |
| 2008/0297070 | A1* | 12/2008 | Kuenzler et al. | 315/308 |
| 2009/0067646 | A1 | 3/2009 | Sato et al. | |

FOREIGN PATENT DOCUMENTS

| | | | |
|---|---|---|---|
| EP | 1460841 | A1 | 9/2004 |
| JP | H06310284 | A | 11/1994 |
| JP | 2007222227 | A | 9/2007 |
| WO | WO200213490 | A2 | 2/2002 |
| WO | WO2004057927 | A1 | 7/2004 |
| WO | 2005058442 | A1 | 6/2005 |
| WO | WO2006111927 | A1 | 10/2006 |

(Continued)

*Primary Examiner* — Mark Rushing
(74) *Attorney, Agent, or Firm* — Meenakshy Chakravorty

(57) ABSTRACT

A lighting system and a method for a operating a lighting system, enabling to obtain an identification tag (7) comprised in lighting design data (5) directly from an output beam (3), i.e. from the emitted light of the at least one lighting unit (2). It is thus possible to trace any unauthorized distribution of a lighting design by monitoring the emitted light without the need to directly access the controller or any other part of the lighting system.

7 Claims, 9 Drawing Sheets

(56) References Cited

FOREIGN PATENT DOCUMENTS

| | | | |
|---|---|---|---|
| WO | WO2006111930 | A2 | 10/2006 |
| WO | WO2006111934 | A1 | 10/2006 |
| WO | WO2007052197 | A | 5/2007 |
| WO | WO2007072327 | A2 | 6/2007 |
| WO | WO2007/099472 | A1 | 9/2007 |

* cited by examiner

```
<! DOCTYPE atmosphere SYSTEM "atmo.dtd">
<atmosphere name="Summer picture 2" id="18">
<owner="shop abc">

<scene>
<! -- Cash register -->
        <lightelement areaselector="\cash register area" fadeintime="0"
        fadeouttime="0">
            <lighteffecttype>
                <ambient intensity="200" colour="0.48, 0.6" />
            </lighteffecttype>
        </lightelement>

        <lightelement areaselector="\cash register area" fadeintime="0"
        fadeouttime="0">
            <lighteffecttype>
                <accent intensity="2000" colour="0.3, 0.3" />
            </lighteffecttype>
        </lightelement>

        <lightelement areaselector="\cash register" fadeintime="0"
fadeouttime="0">
            <lighteffecttype>
                <accent intensity="2000" colour="0.3, 0.3" />
            </lighteffecttype>
        </lightelement>

<! -- ladies fashion\designer 1 -- >

        <lightelement areaselector="\ladies fashion\designer 1\clothing rack"
        fadeintime="0" fadeouttime="0">
            <lighteffecttype>
                <accent intensity="2000" colour="0.3, 0.3" / >
            </lighteffecttype>
        </lightelement>

        <lightelement areaselector="\ladies fashion\designer 1\mannequin"
        fadeintime="0" fadeouttime="0">
            <lighteffecttype condition="noperson">
                <accent intensity="5000" colour="0.55, 0.4" / >
            </lighteffecttype>
            <lighteffecttype condition="personnear">
                <accent intensity="2000" colour="0.3, 0.3" / >
            </lighteffecttype>
        <lightelement>
```

FIG. 6a

```
<lightelement areaselector="\ladies fashion\designer 1\wall"
      fadeintime="0" fadeouttime="0">
    <lighteffecttype>
        <architectural>
            <picturewallwash pngfile="summer_2_left.png"
            intensity="2000" />
        </architectural>
    </lighteffecttype>
</lightelement>
<lightelement areaselector="\ladies fashion\designer 2\clothing
rack" fadeintime="0" fadeouttime="0">
    <lighteffecttype>
        <accent intensity="500" colour="0.3, 0.3" />
    </lighteffecttype>
</lightelement>

<!-- ladies fashion\designer label 3 -->

<lightelement areaselector="\ladies fashion\designer 3\clothing
rack" fadeintime="0" fadeouttime="0">
    <lighteffecttype>
        <accent intensity="2000" colour="0.3, 0.3" />
    </lighteffecttype>
</lightelement>

<lightelement areaselector="\ladies fashion\designer 3\wall"
fadeintime="0" fadeouttime="0">
    <lighteffecttype>
        <architectural>
            <wallwash intensity="1500" colour="0.2, 0.05" />
        </architectural>
    </lighteffecttype>
</lightelement>

<lightelement areaselector="\ladies fashion\designer 3\mannequin"
fadeintime="0" fadeouttime="0">
    <lighteffecttype condition="noperson">
        <accent intensity="5000" colour="0.55, 0.4" />
    </lighteffecttype>
    <lighteffecttype condition="personnear">
        <accent intensity="2000" colour="0.3, 0.3" />
    </lighteffecttype>
</lightelement>
```

FIG. 6b

```
<! -- discount -->

        <lightelement areaselector="\discount" fadeintime"0"
        fadeouttime="0">
            <lightdistribution coordinatesystem="3D" intensity="500">
                <shape type="square">
                    <vertex x="-0.5" y=" 0.5" />
                    <vertex x="-0.5" y="-0.5" />
                    <vertex x=" 0.5" y="-0.5" />
                    <vertex x=" 0.5" y=" 0.5" />
                </shape >
                <colourpoints>
                    <colour colour="0.2, 0.15" />
                    <colour colour="0.3, 0.2" />
                    <colour colour="0.4, 0.3" />
                    <colour colour="0.5, 0.4" />
                </colourpoints>
            </lightdistribution>
        </lightelement>

        <lightelement areaselector="\discount\ladies fashion\wall"
        fadeintime="0" fadeouttime="0">
            <lighteffecttype>
            <architectural>
                <picturewallwash pngfile="picturewallwashdiscount.png"
                intensity="3500" />
            </architectural>
            </lighteffecttype>
        </lightelement>

        <lightelement areaselector="\discount\ladies fashion\mannequin"
        fadeintime="0" fadeouttime="0">
            <lighteffecttype condition="noperson">
                <accent intensity="3000" colour="0.5, 0.3" />
            </lighteffecttype>
            <lighteffecttype condition="personnear">
                <accent intensity="3000" colour="0.3, 0.3" />
            </lighteffecttype>
        </lightelement>

</scene>
</atmosphere>
```

FIG. 6c

LIGHTING SYSTEM AND METHOD FOR OPERATING A LIGHTING SYSTEM

FIELD OF THE INVENTION

The invention relates to a lighting system and a method for operating a lighting system.

BACKGROUND OF THE INVENTION

Lighting systems with a plurality of lighting units are being used today for various applications, for example for room lighting applications to create defined lighting scenes. US 2007/0258523 A1 discloses a lighting system with controllable lighting units. A PC is provided for controlling the lighting units through the addresses of the lighting units, stored in a signal control unit.

The recent development of controllable light sources increases the possibilities for a lighting designer. Due to this, the design of lighting scenes rises in significance by allowing to apply various effects and atmospheres without a change in the lighting units. Consequently, such a lighting design can be regarded as a complex work product and thus intellectual property of the designer.

A lighting design is usually implemented in programs or scripts for operating the respective lighting units. An undesirable side-effect of such programs is that copying is generally possible without much effort, enabling use of such lighting design without consent of the designer.

Accordingly, it is an object of this invention to provide a lighting system and a method for operating a lighting system which allows an efficient commercial use of lighting designs.

SUMMARY OF THE INVENTION

The basic idea of the invention is the possibility to obtain an identification tag comprised in lighting design data directly from an output beam, i.e. from the emitted light of the at least one lighting unit. It is thus possible to trace any unauthorized distribution of a lighting design by monitoring the emitted light without the need to directly access any part of the lighting system.

The lighting system comprises at least one controllable lighting unit for providing at least one output beam of light according to control commands, supplied by a controller. The lighting unit may be of any suitable type, for example a commercially available halogen, fluorescent or solid state lighting unit, as for instance an LED or an OLED. At least one parameter of the lighting unit is controllable, for example brightness, color, special effect, e.g. strobe light or a gobo, or the position of the output beam.

For controlling the lighting unit, the controller supplies control commands to the lighting unit. The controller may be of any suitable type, for example a microcontroller, a computer or a lighting controller. The controller may be integrated with other components of the lighting system, for example with the lighting unit or a lamp driver, depending on the application. It may also be possible to provide multiple controllers, in case of the presence of more than one lighting unit in the lighting system, each providing control commands for a respective lighting unit or a group of lighting units.

The controller comprises means for receiving the lighting design data, which may be of any suitable type. Exemplary, the means for receiving the lighting design data may be an interface for obtaining the lighting design data from a network or a storage medium, such as a memory card, a CD/DVD or a server.

According to the invention, the controller is configured to generate said control commands from said lighting design data comprising an identification tag, wherein said control commands are generated so that said output beam comprises a detectable signal, corresponding to said identification tag.

As mentioned before, it is thus possible to obtain the identification tag by monitoring the output beam of light and the contained detectable signal, for example, using a suitable detector, adapted to receive said signal and to retrieve said identification tag. It may although not be necessary, that the identification tag can be directly taken from the signal, as long as information is contained in the signal, which corresponds to said identification tag. For example, the detectable signal may comprise mapping information, allowing to retrieve the corresponding identification tag from a database. It is however preferred, that the identification tag is directly comprised in the emitted signal.

The lighting design data comprises at least said identification tag together with a lighting definition for obtaining a specific lighting scene or a set of such lighting definitions, for example a sequence of lighting scenes in case of time-dependent lighting effects. Most simply, the lighting definitions may for example include specific control commands for setting at least one parameter of a lighting unit, although the invention is not limited hereto. Preferably, the lighting design data is digital data.

According to the invention, the identification tag may be represented in the lighting design data in any suitable way. For example, the identification tag may be already implemented or embedded in the lighting definitions, for obtaining the lighting scenes. Alternatively, the identification tag may be comprised together with the lighting definitions in the lighting design data, which could be regarded as a data container. In this case, the controller "merges" the lighting definitions with the identification tag to generate said control commands for obtaining an output beam according to the lighting definitions comprising the detectable signal. In any case, the lighting design data should preferably be protected, so that the identification tag cannot be removed from the lighting design data.

The identification tag may comprise any information relating to the lighting design data. The identification tag may for example contain metadata of the lighting design. Preferably, the identification tag comprises information, which enables to trace the origin of the lighting design data. Such information may for example include details with regard to the lighting designer, the owner or the licensee of the lighting design. For example, a lighting design for a hotel chain may comprise the name of the hotel. Most preferably, the identification tag comprises information, individualizing the lighting design data. Such information individually describes certain lighting design data and thus a certain lighting design. It is thus possible to clearly determine a specific lighting design, when obtaining the identification tag from the output beam, advantageously enabling to determine whether the lighting design data is used illicitly by directly monitoring the output beam of light.

The identification tag may further or alternatively comprise information of the venue, for example an address of the shop, for which the lighting design has been made originally.

According to a preferred embodiment of the invention, the lighting design data comprises abstract atmosphere definitions. Using abstract atmosphere definitions it is possible to describe a lighting scene independent of a location or venue of the set-up of the installed light sources. Because of the possibility of universal use, such lighting design data is especially vulnerable to misuse.

In context of the present invention, the term "abstract atmosphere definition" means a definition of the atmosphere, i.e. the lighting scene, at a higher level of abstraction than a description of settings of the intensity, color or the like of every individual lighting unit of a lighting system. For example, the description of the type of a lighting scene such as "diffuse ambient lighting", "focused accent lighting" or "wall washing" is considered an abstract atmosphere definition. Further, the description of certain lighting parameters such as intensity, color or color gradient at certain semantic locations and/or certain semantic times, for example "blue with low intensity in the morning at the cash register" or "dark red with medium intensity at dinner time in the whole shopping area" is also considered an abstract atmosphere definition. Herein "semantic location" and "semantic time" means a description of a location or a time such as "cash register" in a shop, "lunch time" or "time >22:00h" in contrast to a concrete description of a location, for example with coordinates or of a time with an exact expression of the time. When creating a lighting design using abstract atmosphere definitions it is possible to include some parameters as abstract definitions, while other parameters are defined as a concrete description of a setting.

Lighting design data comprising abstract atmosphere definitions may preferably be generated from user input to which the identification tag is added before the lighting design data is supplied to the lighting system. For example, the user may define a lighting scene, such as "diffuse ambient lighting", as mentioned before. The identification tag is then added to the lighting design data and preferably encrypted, so that a removal of the identification tag is not possible. For obtaining the desired lighting, the abstract atmosphere definitions need to be rendered or mapped to control commands for the at least one lighting unit. Most preferably, the controller is configured to map the abstract atmosphere definitions to control commands for the at least one lighting unit.

The detectable signal may be of any suitable type, allowing to transfer information in the output beam of light. For example, a modulation in brightness of the irradiated light, i.e. an amplitude modulation could be used to form the detectable signal. Further alternatives include a color or light temperature variation or a specific pattern, if the lighting unit provides for such controllable parameters. Instead of an amplitude modulation, other types of modulation known in the art, such as a pulse-width, pulse density, frequency or pulse-position modulation may be used.

Preferably, the detectable signal is invisible to the human eye, so as not to interfere with any lighting effect. Exemplary, the detectable signal may be modulated with an amplitude modulation at a frequency above 100 Hz to make the modulation invisible or at least almost invisible to the human eye.

Further methods for including invisible signals in lighting known in the art may be applied. For example, document WO 2007/099472 A1 discloses a pulse-width modulation for modulating a beam of light and for transporting information therein.

Since it may be possible that an element is arranged in the lighting system, which prevents the distribution of the detectable signal in the output beam, it is preferred that the lighting system comprises at least one detector, arranged to detect said signal in the output beam and to supply information on said signal to the controller. The information enables the controller to compare the signal with the identification tag. Most simply, the information, provided by the detector may be the detected signal itself. Alternatively, the information may be already the identification tag, obtained by the detector from the signal. The controller then compares the information with the identification tag to determine any alteration between the detectable signal and the identification tag. For example, when a removal of the signal is detected, which would make it impossible to obtain the identification tag from the output beam, the controller may stop to further generate control commands for the connected lighting units and thus stop playback of the lighting design data. Alternatively or additionally, the controller may issue a corresponding message, for example to a connected display. Using this preferred embodiment, the overall security of the lighting system is advantageously further enhanced, since the avoidance of the distribution of the identification tag and thus avoidance of the security measures of the lighting system is not possible.

According to a preferred embodiment, the lighting system comprises multiple lighting units for providing multiple output beams. The controller is configured to generate control commands so that each output beam comprises said detectable signal. The present embodiment thus advantageously simplifies the detection of the signal.

Preferably, variable storing means are provided for storing the lighting design data and for supplying said lighting design data for the generation of said control commands. The storing means thus provide the lighting design data to the controller for generation of the control commands. The storing means may be integrated with the controller or may be a separate component, for example, a data server in a network or any type of memory or storage medium. The storing means may also be a part of a system for generation of lighting design data.

As mentioned before, the lighting design data is preferably protected, so that the identification tag cannot be removed from the lighting design data.

According to a preferred embodiment, the lighting design data is encrypted digital data and the controller has means for decrypting the lighting design data.

For encrypting the lighting design data any suitable encryption method known in the art may be applied, which assures that the identification tag cannot be removed from the lighting design data.

Most preferred, the lighting design data is encrypted, so that the "clear-text" design cannot be retrieved from the data. Using this preferred embodiment, only "trusted" controllers may decrypt the lighting design data, which further enhances the overall security of the system.

In the present embodiment, the controller has suitable means for decryption, which may be implemented in hardware and/or software to be able to generate the control commands.

Exemplary, the data may be encrypted using an encryption key, such as used in DES, blowfish or AES encryption methods. The key is only known to the designer of the lighting design data and to the controller, which then may decrypt the lighting design data using the specific algorithm. Alternatively, more advanced encryption methods may be used, such as public-key cryptography, for example used in PGP.

BRIEF DESCRIPTION OF THE DRAWINGS

The above and other objects, features and advantages of the present invention will become apparent from the following description of preferred embodiments, in which:

FIG. 6*a*-6*c* shows an XML file as an embodiment of an abstract atmosphere definition.

DETAILED DESCRIPTION OF EMBODIMENTS

Figure 1:
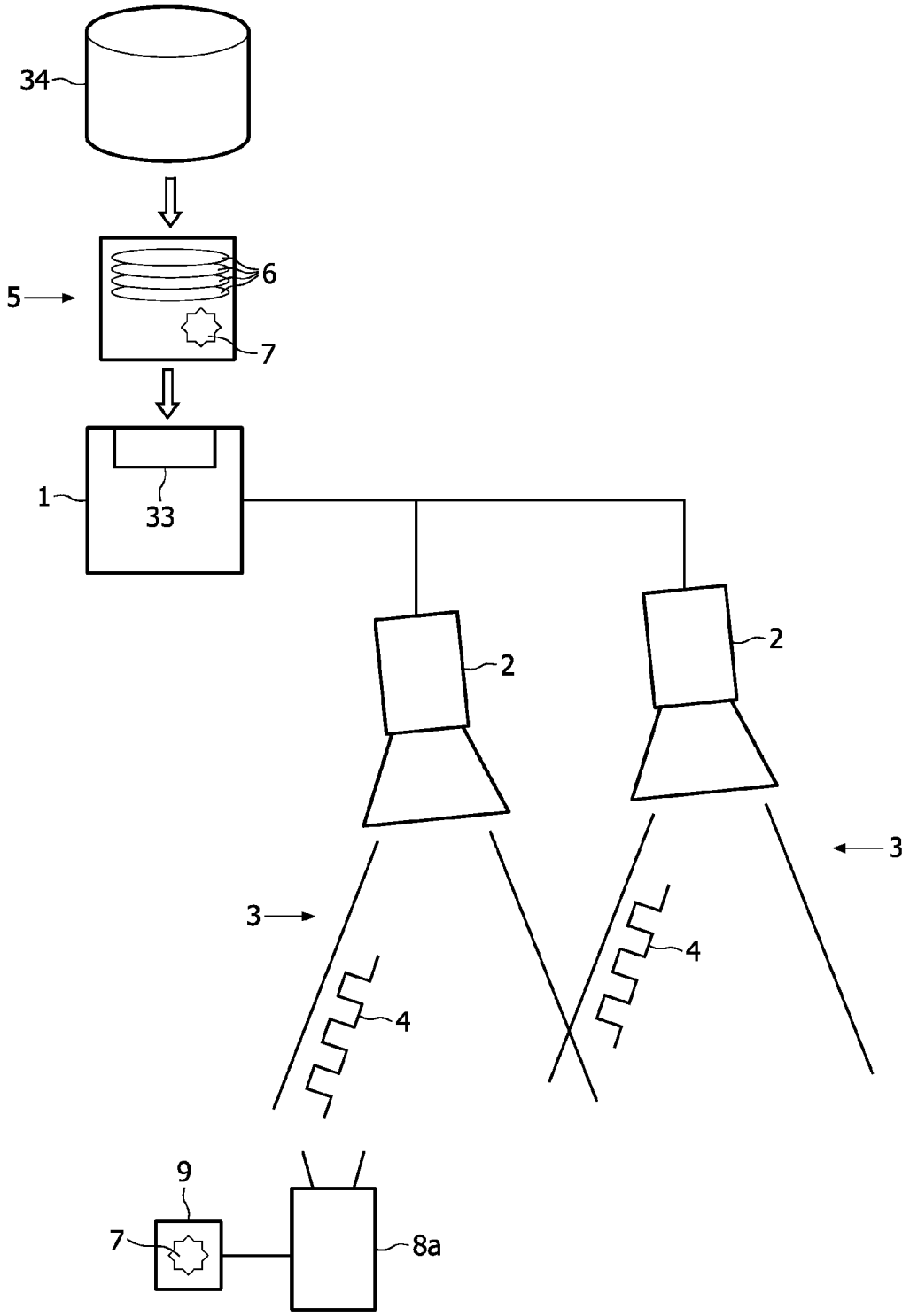
FIG. 1 shows a first embodiment of a lighting system according to the invention.

In the following description, the terms "lighting device", "lighting unit", "light unit" and "lamp" are used as synonyms. These terms mean herein any kind of electrically controllable lighting device such as a semiconductor-based illumination unit such as an LED, an OLED, a halogen bulb, a fluorescent lamp, a light bulb. Furthermore, (functional) similar or identical elements in the drawings may be denoted with the same reference numerals.

FIG. 1 shows a first embodiment of a lighting system according to the invention. A controller, here a lighting management system 1 is connected to controllable lighting units 2 to illuminate a room with specific lighting scenes. The lighting units 2 comprise high-power LEDs and are controllable at least in terms of brightness and color. The lighting management system 1 supplies control commands to the lighting units 2 for providing output beams 3. The control commands are generated by the lighting management system from lighting design data 5, received by an interface 33. The lighting design data is supplied to the lighting management system 1 from a variable database 34. The lighting design data 5 comprises several lighting definitions 6 together with an identification tag 7. The lighting definitions 6 are abstract atmosphere definitions as described with reference to FIG. 4-7, which are used by the lighting management system 1 to generate the control commands for the lighting units 2 to obtain the desired lighting scenes. The identification tag 7 comprises the name of the owner of the lighting design.

The lighting management system 1 generates the control commands, so that the output beams 3 of the lighting units 2 comprise a detectable signal 4, which corresponds to the identification tag 7. The signal 4 is then be interpreted by a suitable detector 8*a* to obtain the identification tag 7. The information comprised in the identification tag 7, i.e. the name of the owner of the lighting design is then shown on a display 9. It is thus possible to obtain the identification tag 7 directly from the output beams 3 to determine if the lighting design is used legally.

For generating the detectable signal 4, the lighting management system 1 generates control commands, modulating the brightness of the lighting units 2 with a pulse-width modulation. The frequency of the pulse width modulation is chosen above 400 Hz, which makes the modulation invisible to the human eye. The brightness of the emitted light of the lighting units 2 is adjusted by varying the duty cycle of the pulse-width modulation.

Figure 2:
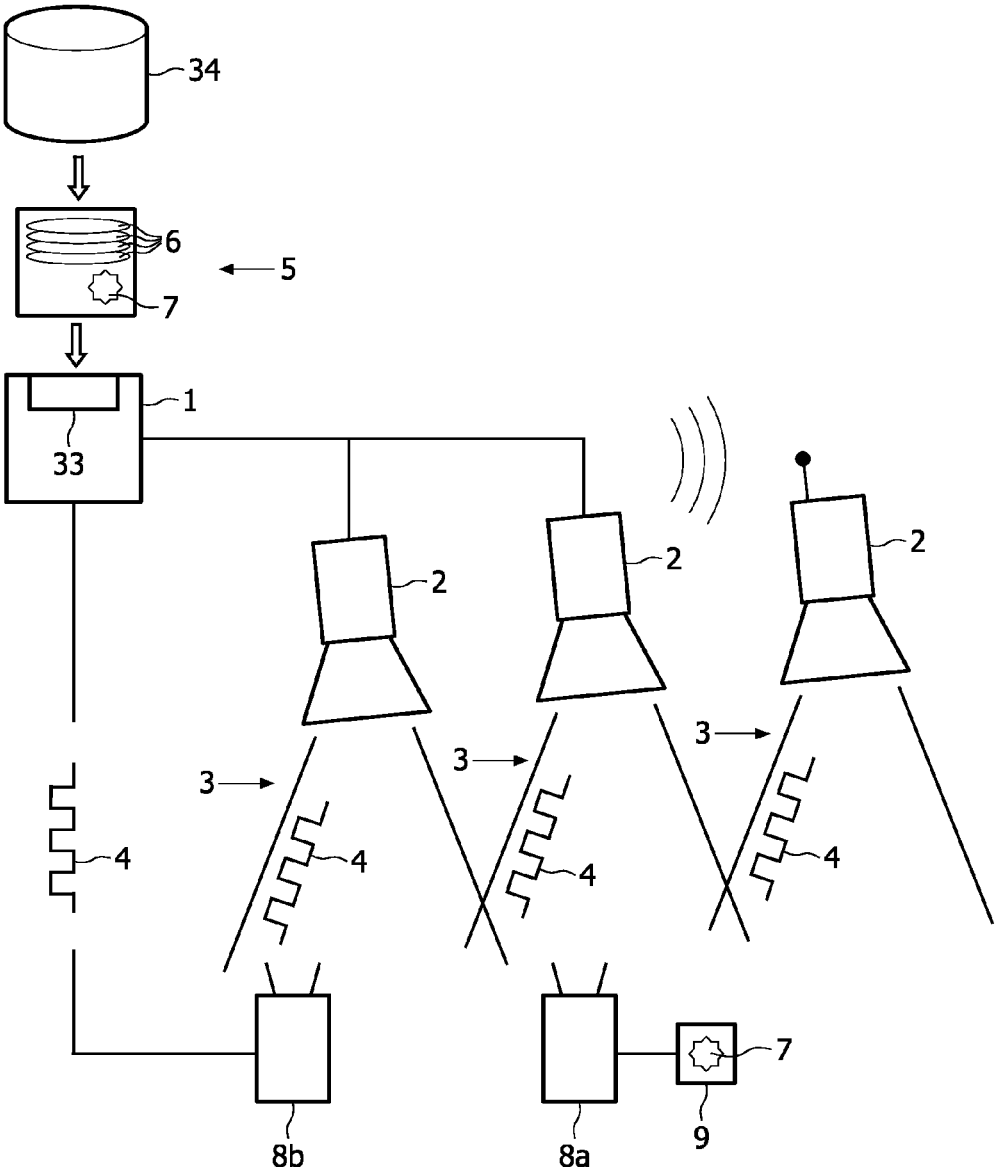
FIG. 2 shows a second embodiment of a lighting system.

A second embodiment of the invention is shown in FIG. 2. Here, a second detector 8*b* is arranged to receive the signal 4 from one of the output beams 3 and is connected to the lighting management system 1. The detector 8*b* provides the signal 4 to the lighting management system 1, which then compares the signal 4 with the identification tag 7. If the signal 4 does not correspond to the identification tag 7 or is missing entirely, the lighting management system 1 stops the generation of the control commands from the lighting design data 5. This setup makes sure that the components of the lighting system support the underlying security system and assures that the signal 4 is comprised in the output beams. For example, it is not possible to filter the signal 4 from the control commands or from the output beams 3, which further enhances the security of the lighting system 3.

Figure 3:
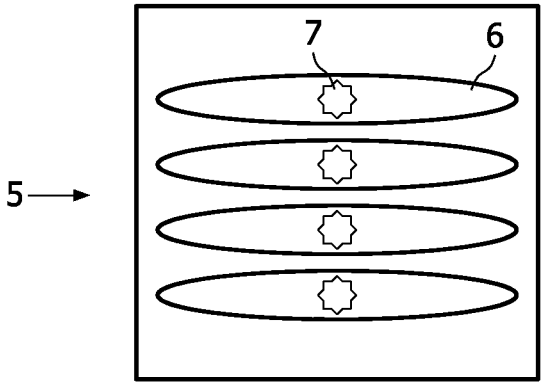
FIG. 3 shows an alternative representation of lighting design data.

As can be further seen from FIG. 2, the lighting units 2 can be connected to the lighting management system 1 either wired or wireless, allowing a flexible set-up of the lighting system. Although not shown, also the detector 8*b* may be connected wirelessly to the lighting management system 1. FIG. 3 illustrates an alternative representation of lighting design data 5. Here, the identification tag 7 is embedded in the lighting definitions 6.

Several modifications to the above embodiments are possible:

- The signal 4 may be incorporated in the output beams 3 with different modulations, for example pulse-density modulation. Signal 4 may also be a colour or light temperature modulation.
- The database 34 may be formed integrally with the lighting management system 1.
- The identification tag 7 may comprise further or additional information, for example metadata of the lighting design.
- The lighting definitions 6 may comprise concrete control commands for the lighting units 2, instead of abstract atmosphere definitions.
- The detector 8*b* may be configured to obtain the identification tag 7 from the signal 4 and to provide the obtained identification tag 7 to the lighting management system 1, instead of providing the signal 4 to the lighting management system 1.
- Lighting design data 5 may be encrypted data to further enhance the overall security and to assure that the identification tag 7 cannot be removed from the lighting design data 5. In this case, the lighting management system 1, e.g. the interface 33, may provide decryption means. Such decryption means may be implemented in hardware and/or software.
- Lighting design data 5 may for example be encrypted using an encryption key, such as used in DES, blowfish or AES encryption methods. The key is supplied to the lighting management system 1, e.g. the interface 33, which then may decrypt the lighting design data using the specific algorithm. Alternatively, more advanced encryption methods may be used, such as public-key cryptography, for example used in PGP.
- The signal 4 may comprise a reference to the identification tag 7, instead of a representation of the identification tag 7 itself, allowing to retrieve the identification tag 7 from a data storage.
- At least some of the functionality of the lighting management system 1 may be implemented in software.

The generation of abstract atmosphere definitions and the use of such definitions in a lighting system to generate control commands for lighting units 2 is explained with reference to FIGS. 4-7. In the following, the terms "abstract atmosphere definition", "abstract atmosphere description" and "abstract description" are used as synonyms.

Figure 4:
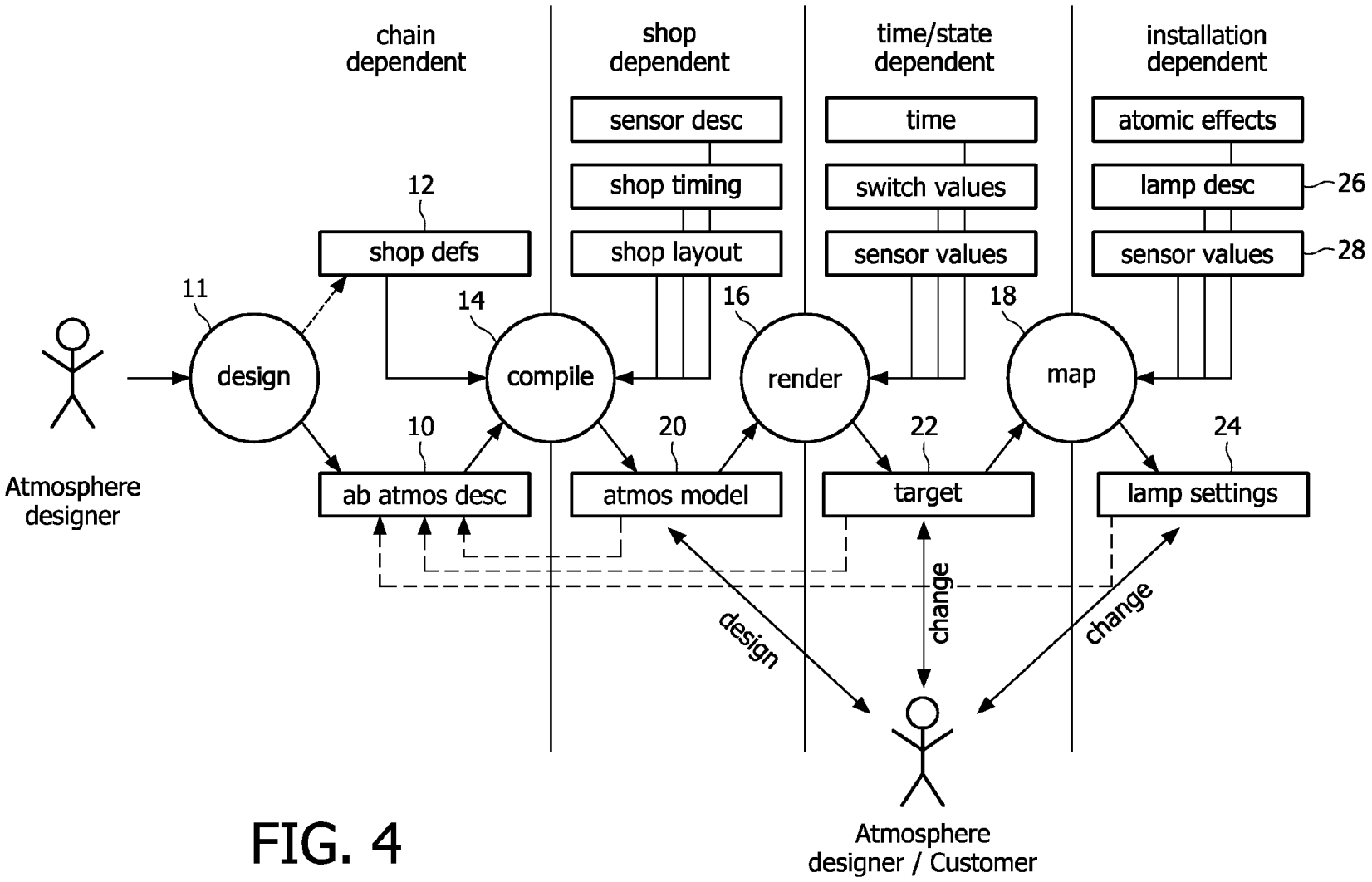
FIG. 4 shows a flow diagram of an embodiment of a method for composing a lighting atmosphere from an abstract atmosphere definition.

An overview of the flow according to the method for composing a lighting atmosphere from an abstract description for a shop is depicted in FIG. 4. Via some design process 11, for example by using a lighting atmosphere composition computer program with a graphical user interface (GUI), an abstract atmosphere description 10 is created (in FIG. 4 also denoted as ab atmos desc). The abstract atmosphere description can also be generated from one of the interaction methods depicted at the bottom of FIG. 4. The abstract description 10 merely contains descriptions of lighting effect at certain semantic locations at certain semantic times/occasions. The lighting effects are described by the type of light with certain parameters. The abstract description 10 is shop layout and lighting system independent. Thus, it may be created by a lighting designer without knowledge about a specific lighting system and lighting environment such as a room layout. The designer must know only semantic locations of the lighting environment, for example "cash register" or "shoe box 1", "shoe box 2", "changing cubicle", "coat stand" in a shoe or fashion shop. When using a GUI for creating the abstract description 10, it may be for example possible to load a shop layout template containing the semantic locations. Then the designer can create the lighting effects and the atmosphere by for example drag and drop technology from a palette of available lighting devices. The output of the computer program with the GUI may be a XML file containing the abstract description 10.

An example of an XML file containing such an abstract atmosphere description is shown in FIG. 6A to 6C. In the abstract atmosphere description, elements of the light atmosphere description are linked to semantic (functional) locations in the shop. As can be seen in FIG. 6A to 6C, the semantic locations are introduced by the attribute "areaselector". The lighting atmosphere at this semantic location is introduced by the tag name "lighteffecttype". The type of light with lighting parameters is described by the tag names "ambient", "accent", "architectural" and "wallwash", as picture by using the tag names "architectural" and "picutrewallwash", or as a lightdistribution. The parameters are described by the attributes "intensity", for example of 2000 (lux/nit), and "color", for example x=0.3, y=0.3. In case of a picture wall washing effect the shown picture is specified by the attribute "pngfile" and its intensity. In case of a light distribution, the intensity is specified, the colour at the corners of the area and possibly parameters specifying the s-curve of the gradient. Furthermore, for some lights fading in and out may be specified by the attributes "fadeintime" and "fadeouttime". The name of the owner of the lighting design is included in an identification tag "owner".

Such an abstract description is automatically translated into control values for the different lighting devices or units, i.e., lamps of a specific instance of a lighting system (in FIG. 4 denominated as lamp settings 24) in three stages:

1. Compiling 14 the abstract description 10 into an atmosphere model 20: In the compile stage 14, the abstract (shop layout and light infrastructure independent) atmosphere description 10 is translated into a shop layout dependent atmosphere description. This implies that the semantic locations 12 are replaced by real locations in the shop (physical locations). This requires at minimum some model of the shop with an indication of the physical locations and for each physical location which semantic meaning it has (e.g. one shop can have more than one cash register. These all have different names, but the same semantics). This information is available in the shop layout. Beside the semantic locations, also semantic notions of time (e.g. opening hours) are replaced by the actual values (e.g. 9:00-18:00). This information is available in the shop timing. Furthermore, for light effects that depend on sensor readings, an abstract sensor is replaced by the (identifier of the) real sensor in the shop. These shop dependent values are contained in a shop definitions file 12 containing specific parameters or the shop and the applied lighting system. The shop definitions contain the vocabulary that can be used in the abstract atmosphere, shop layout and shop timing. The output of the compiler stage is the so called atmosphere model 20 (atmos model), which still contains dynamics, time dependencies and sensor dependencies.

2. Rendering 16 the atmosphere model 20 to a target 22: In the rendering stage, all dynamics, time dependencies and sensor dependencies are removed from the atmosphere model 20. As such, the render stage creates a snapshot of the light atmosphere at a certain point in time and given sensor readings at that point in time. The output of the render stage is called the target 22. The target 22 can consist of one or more view points (see dark room calibration) and per view point a color distribution, an intensity distribution, a CRI (Color Rendering Index) distribution, . . . .

3. Mapping 18 the target 22 into actual control values 24 for lighting devices, i.e. the lamp: The mapping stage converts the target 22 into actual lamp control values 24 (lamp settings). In order to calculate these control values 24, the mapping loops requires:

a. Descriptions of the lamps 26 available in the lighting system, like the type of lamp, color space, . . . .
b. The so-called atomic effects 26 which describe which lamp contributes in what way to the lighting of a certain physical location. How these atomic effects are generated is described below.
c. In case of controlling the lights with a closed feedback loop, the sensor values 28 to measure the generated light.

Based on these inputs 26 and 28 and the target 22, the mapping loop 18 uses an algorithm to control the light units or lamps, respectively, in such a way that the generated light differs as little as possible from the target 22. Various control algorithms can be used, like classical optimization, neural networks, genetic algorithms etc.

As already indicated, the mapping process 18 receives a target light "scene" from the rendering process 16. In order to calculate the lamp settings 24 required to generate light that approximates the target 22 as close as possible, the mapping process 18 needs to know which lamps contribute in what way to the lighting of a certain physical location. This is done by introducing sensors, which can measure the effects of a lighting device or lamp, respectively, in the environment. Typical sensors are photodiodes adapted for measuring the lighting intensity, but also cameras (still picture, video) may be considered as specific examples of such sensors.

In order to achieve an exact mapping result which matches the target 22 as close as possible, a so-called dark room calibration may be done before the abstract atmosphere description 10 is transferred to the actual lamp control settings 24. The process of calibration is done by driving the light units one by one. Cameras and/or sensors will measure the effect of the single light unit on the environment. Each camera or sensor corresponds to one view point. By measuring the effect in this way, influences of wall colours, furniture, carpet etc. are taken into account automatically. Beside measuring the effect of each light unit, it should be indicated which physical locations are measured for every camera and sensor. As far as cameras are concerned, the camera view itself can be used to indicate the physical locations of the shop.

Figure 5:
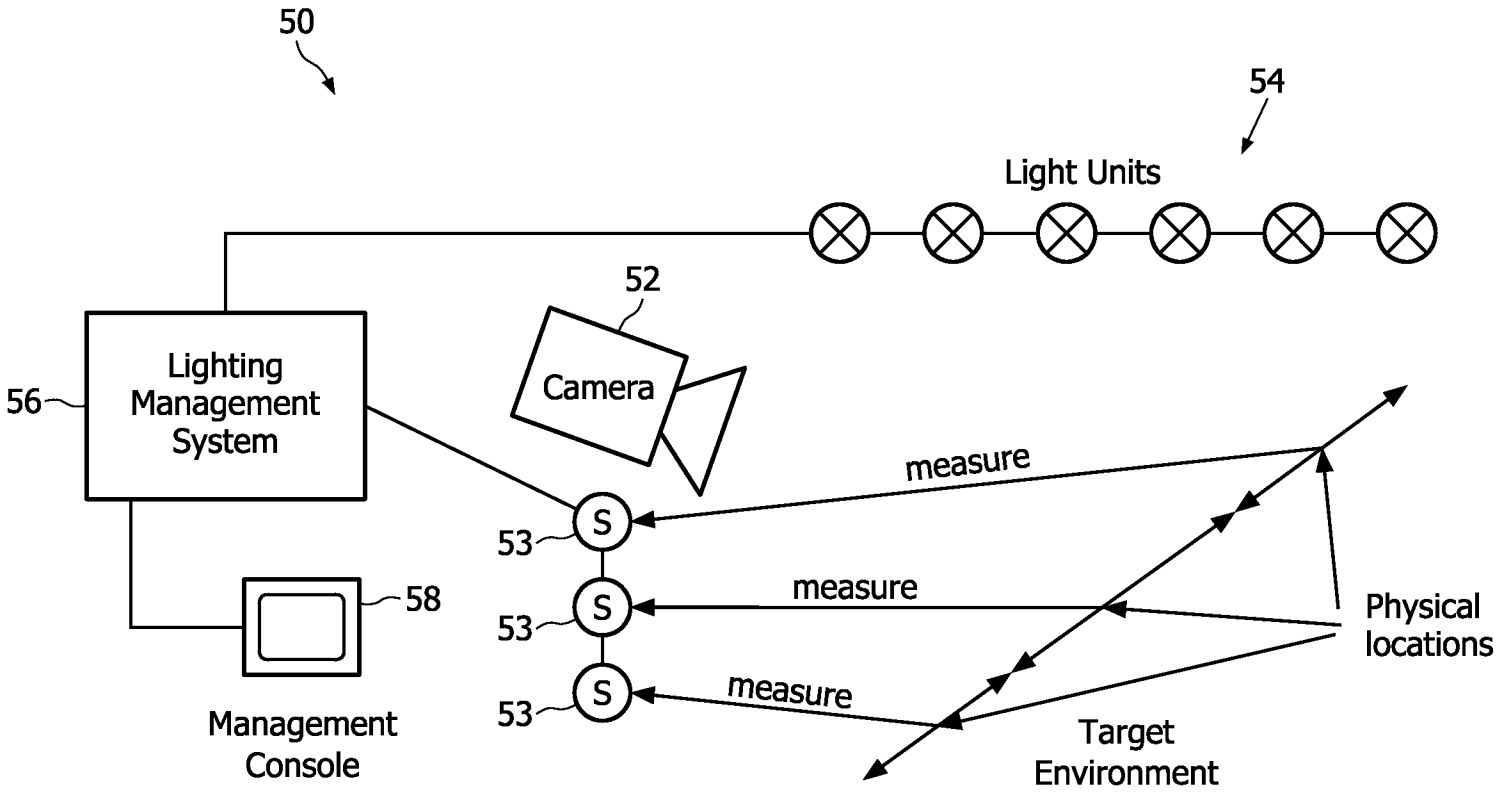
FIG. 5 shows an embodiment of a set up of a lighting system with a camera and sensors for composing a lighting atmosphere from an abstract atmosphere definition.

FIG. 5 shows a possible set up for the calibration of a lighting system 50 with a camera 52 and several sensors 54. The shown lighting system 54 contains:

Controllable light units 54.

Several (light) sensors 53 and a camera 52 infrastructure that can measure the effects of lights created by the light units 54 on the environment.

A lighting management system 56 that can drive the light units 54 and interpret the measurements taken by the camera 52 and the sensors 53. The lighting management system 56 may be implemented by a computer program, executed for example by a Personal Computer (PC).

A management console 58 that displays the views, and is used for interaction with the installer of the lighting management system 56. Sub areas of the view can be selected and related to physical locations of the target environment. The management console 58 can be located close to the target environment, but also remote from the lighting management system. (e.g. in the chain headquarters). In case of a remote location of the management console 58, the lighting management system 56 is connected to a computer network, such as the internet, in order to allow a remote management via the management console 58.

The different views on the environment are displayed on the management console 58. In these views, the installer indicates the physical locations e.g. with a pointing device (mouse, tablet). The views may comprise pictures of a real shop and certain physical locations (shoebox 1, shoebox2, isleX) in the shop indicated as highlighted sections in the picture, created by an installer on the management console 58.

During dark room calibration, the effects of the light units 54 on the environment and thus the physical locations are measured. In the dark room calibration procedure, the effects of the different light units 54 are tested in conditions which are constant and measurable. The best conditions are those where daylight is at minimum (e.g. at night, with closed blinds). The calibration process comprises essentially the following steps:

First, the light management system 56 turns all the light units 54 off, and measures the lighting effects that are present. These will be subtracted from the measured effects of the lights later on. In dark room conditions, this background effect is nihil or very small.

Then light units 54 are driven one by one, a representative set of control values is used. This control set shows the features of the light units 54 one by one. For every light unit 54 and control setting, the effect on the environment is described and stored (atomic effect).

The atomic effects are then used to realize the effects in the lighting design.

Figure 7:
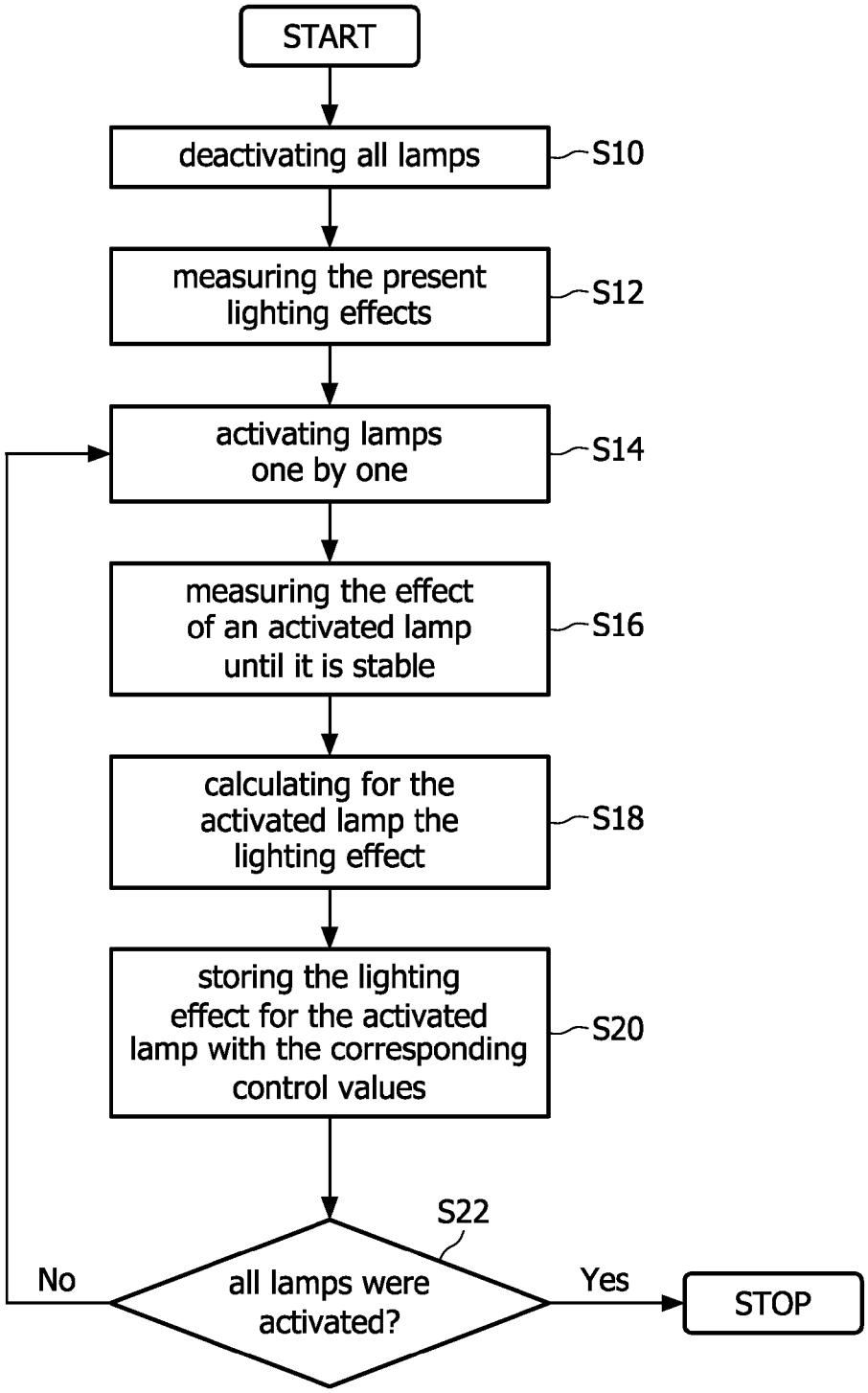
FIG. 7 shows a detailed sequence of steps of an embodiment of a calibration process.

The detailed sequence of steps of the calibration process is shown in FIG. 7. In step S10, all lamps are deactivated, i.e. switched off. Then, in step S12 the present lighting effects are measured and the measurement values are stored as dark light values. Afterwards, the lamps of the lighting system are activated, i.e. switched on one by one by using a representative set of control values for the lamps (step S14). The effect of each lamps is measured at several different physical locations in step S16 until it is stable. In the following step S18, for every lamps the lighting effect on the environment is calculated by subtracting the stored dark light values from the stable measurement values of the effect of each lamps. In step S20, the lighting effect for the representative set of control values for each lamps is stored. In step S22, it is checked whether all lamps were already activated. If yes, the calibration process stops. If no, the process returns to step S14.

If the same physical location appears in two view points, the measurements for the light effects in the views are compared and matched. Differences can have several reasons: e.g. the lamp provides ambient white light and the views are orthogonal so they have a different background, with maybe different colors. In such a case, the installer is triggered and has to select or describe the atomic effect via user interaction.

When light units are added to the calibrated system, a service discovery protocol may detect them, and the lighting management system asks for features of the lamps. Representative control sets are generated, and a dark room calibration (only for these light units) can be started on demand or automatically.

The invention has been illustrated and described in detail in the drawings and foregoing description. Such illustration and description are to be considered illustrative or exemplary and not restrictive; the invention is not limited to the disclosed embodiments.

In the claims, the word "comprising" does not exclude other elements, and the indefinite article "a" or "an" does not exclude a plurality. The mere fact that certain measures are recited in mutually different dependent claims does not indicate that a combination of these measures cannot be used to advantage. Any reference signs in the claims should not be construed as limiting the scope.

The invention claimed is:

1. A method for operating a lighting system with at least one lighting unit, the method comprising:

receiving lighting design data, said lighting design data including an identification tag and including a lighting definition for obtaining a specific lighting scene;

translating the lighting design data to control values for at least one lamp, the control values for the at least one lamp including the identification tag;

wherein the translating of the lighting design data includes:

compiling the lighting design data into an atmosphere model;

rendering the atmosphere model to a target;

mapping the target into the control values for controlling the at least one lighting unit;

wherein the identification tag is embedded within the control values after the translating step.

2. Lighting system according to claim 1, wherein said identification tag comprises information associated with individual elements of the lighting design data.

3. Lighting system according to claim 1, wherein said lighting design data comprises abstract atmosphere definitions.

4. Lighting system according claim 1, wherein said control values include a detectable signal in an output beam invisible to the human eye.

5. Lighting system according to claim 4, comprising at least one detector, arranged to detect said signal in said output beam, wherein the detector is configured to supply information on said signal to a controller for comparing data from said signal with said identification tag so that the generation of control values is stopped, when said signal does not correspond to said identification tag.

6. Lighting system according to claim 4, wherein multiple lighting units are arranged for providing multiple output beams and a controller is configured to generate said control values so that each output beam comprises said detectable signal.

7. Lighting system according claim 1, wherein variable memory storage are provided for storing said lighting design data, which supply said lighting design data for said generation of said control values.

* * * * *